US007654691B2

(12) United States Patent
Liu et al.

(10) Patent No.: US 7,654,691 B2
(45) Date of Patent: Feb. 2, 2010

(54) LIGHT-GUIDING MODULES AND LED LAMP USING THE SAME

(75) Inventors: You-Xue Liu, Shenzhen (CN); Yong Wu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/255,660

(22) Filed: Oct. 21, 2008

(65) Prior Publication Data

US 2009/0323323 A1 Dec. 31, 2009

(30) Foreign Application Priority Data

Jun. 25, 2008 (CN) ..... 2008 1 0068106

(51) Int. Cl.
*F21V 7/00* (2006.01)
*F21V 29/00* (2006.01)

(52) U.S. Cl. ..... 362/249.02; 362/294; 362/319; 362/346; 362/373; 362/800

(58) Field of Classification Search ..... 362/346, 362/323, 319, 294, 373, 547, 545, 800, 249.02
See application file for complete search history.

(56) References Cited

U.S. PATENT DOCUMENTS

| | | | | |
|---|---|---|---|---|
| 7,070,310 | B2 * | 7/2006 | Pond et al. | 362/545 |
| 7,244,058 | B2 * | 7/2007 | DiPenti et al. | 362/547 |
| 7,407,307 | B2 * | 8/2008 | Hiratsuka | 362/304 |
| 2003/0043590 | A1 * | 3/2003 | Walser et al. | 362/494 |
| 2003/0156416 | A1 * | 8/2003 | Stopa et al. | 362/294 |
| 2004/0233672 | A1 * | 11/2004 | Dubuc | 362/294 |

* cited by examiner

*Primary Examiner*—Laura Tso
(74) *Attorney, Agent, or Firm*—Frank R. Niranjan

(57) ABSTRACT

An LED lamp includes a heat sink, a plurality of LED modules mounted on the heat sink and a plurality of light-guiding modules respectively fixed on the LED modules. Each light-guiding module comprises a frame having a bottom panel placed on the LED module and two side panels extending upwardly from two opposite edges of the bottom panel and a plurality of guiding units each having two engaging flanges extending outwardly from two opposite lateral sides thereof. Each guiding unit receives an LED of a corresponding LED module therein. The two side panels respectively define two runners in inner sides thereof. The two engaging flanges of each guiding unit are respectively received in the two runners of the frame and movable therealong to adjust a position of the guiding unit in the frame.

16 Claims, 4 Drawing Sheets

LIGHT-GUIDING MODULES AND LED LAMP USING THE SAME

BACKGROUND OF THE INVENTION

1. Field of the Invention

The disclosure relates to an LED lamp, and more particularly to an LED lamp using light-guiding modules applicable with various types of LED modules.

2. Description of Related Art

An LED lamp is a type of solid-state lighting that utilizes light-emitting diodes (LEDs) as a source of illumination. LEDs convert electricity to light via current through a junction region comprising two different semiconductors, by which electrons and holes coupled at the junction region generate the light. LED advantages of resistance to impact and nearly limitless lifetime under specific conditions make an LED lamp a cost-effective yet high quality replacement for incandescent and fluorescent lamps.

Known implementations of LED modules in an LED lamp use a plurality of individual LEDs to generate light reflected by a light-guiding module to obtain sufficient illumination of suitably wide distribution. A conventional light-guiding module is integrally fabricated and suited only for use in the type of LED lamp for which its use is intended, such that in order to equip a variety of LED lamps, development and manufacture of a wide range of light-guiding module types are required, representing considerable cost and material burdens.

What is needed, therefore, is a light-guiding module suitable for application with a variety of LED lamp types, thereby overcoming the described limitations.

SUMMARY OF THE INVENTION

An LED lamp includes a heat sink, a plurality of LED modules mounted on a top of the heat sink, and a plurality of light-guiding modules fixed on the LED modules. Each light-guiding module comprises a frame having a bottom panel placed on the LED module, two side panels extending upwardly from two opposite edges of the bottom panel, and a plurality of guiding units each having two engaging flanges extending outwardly and laterally from two opposite lateral sides thereof. Each guiding unit receives an LED of a corresponding LED module therein for reflecting and guiding light generated by the LED. The two side panels respectively define two runners in inner sides thereof and facing each other. The two engaging flanges of each of the guiding units are respectively received in the two runners of the frame and movable therealong, allowing adjustment of a position of the guiding unit in the frame.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
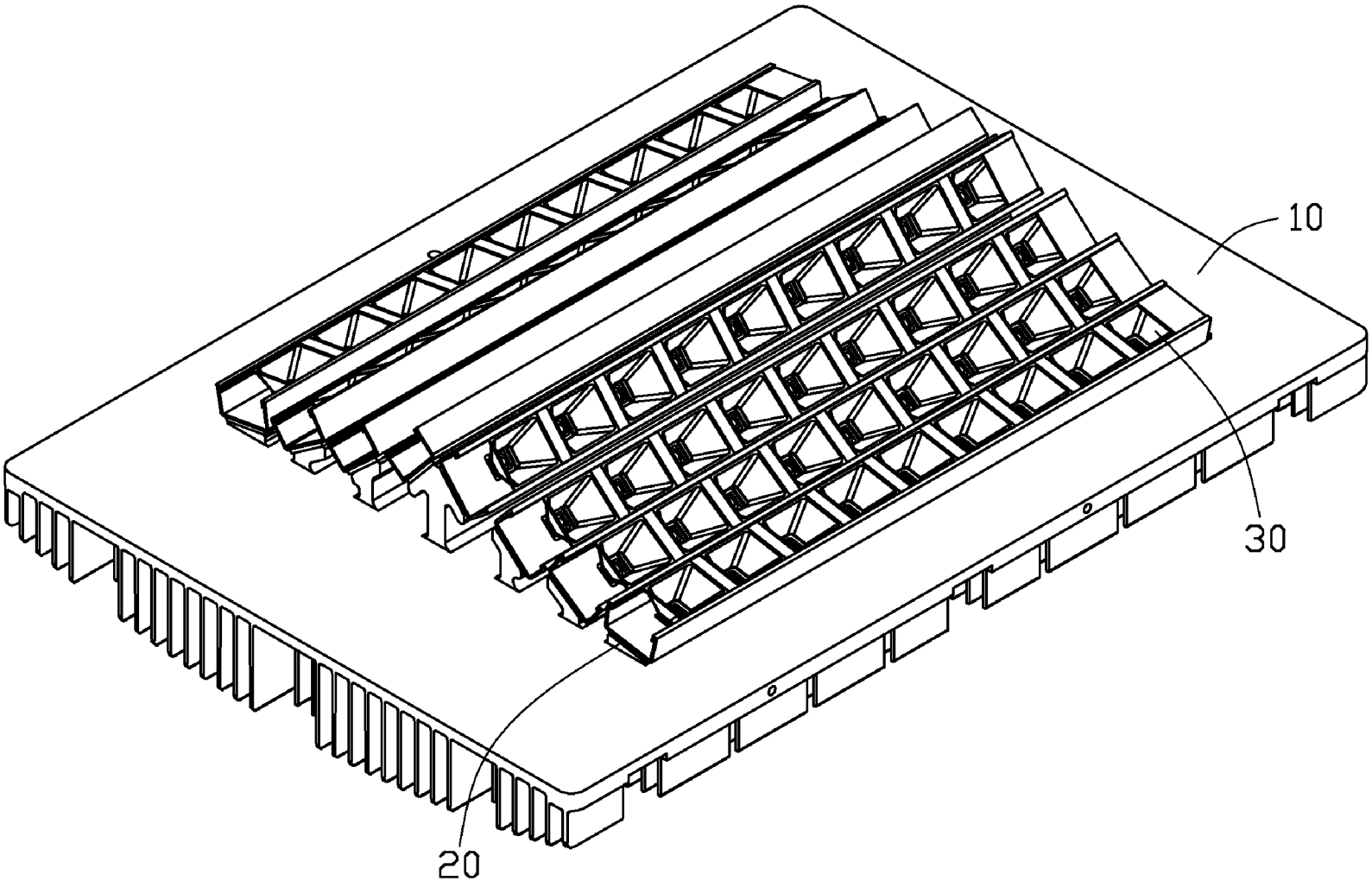
FIG. 1 is an isometric, assembled view of an LED lamp in accordance with a preferred embodiment of the disclosure.
Figure 2:
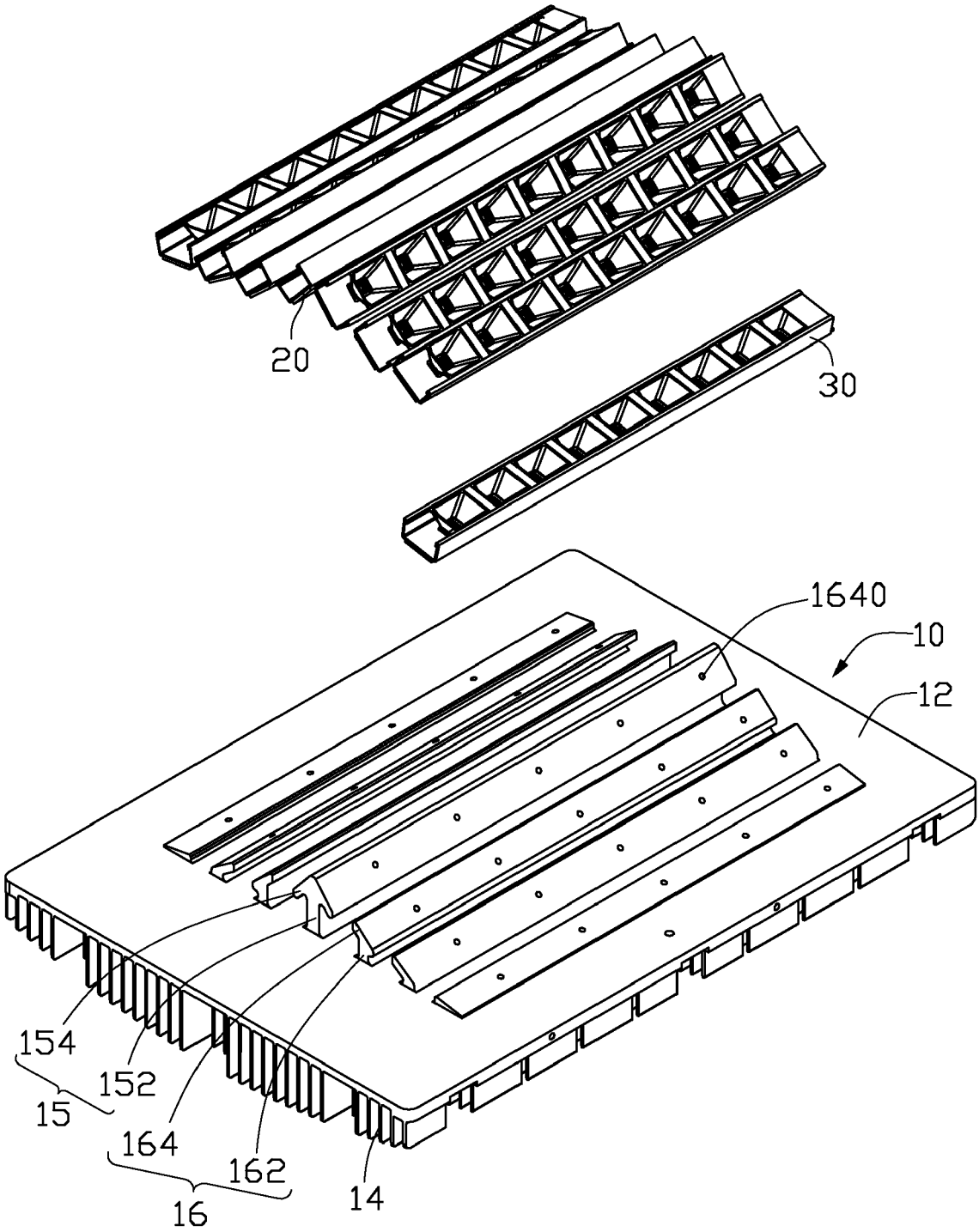
FIG. 2 is an exploded view of the LED lamp of FIG. 1.
Figure 3:
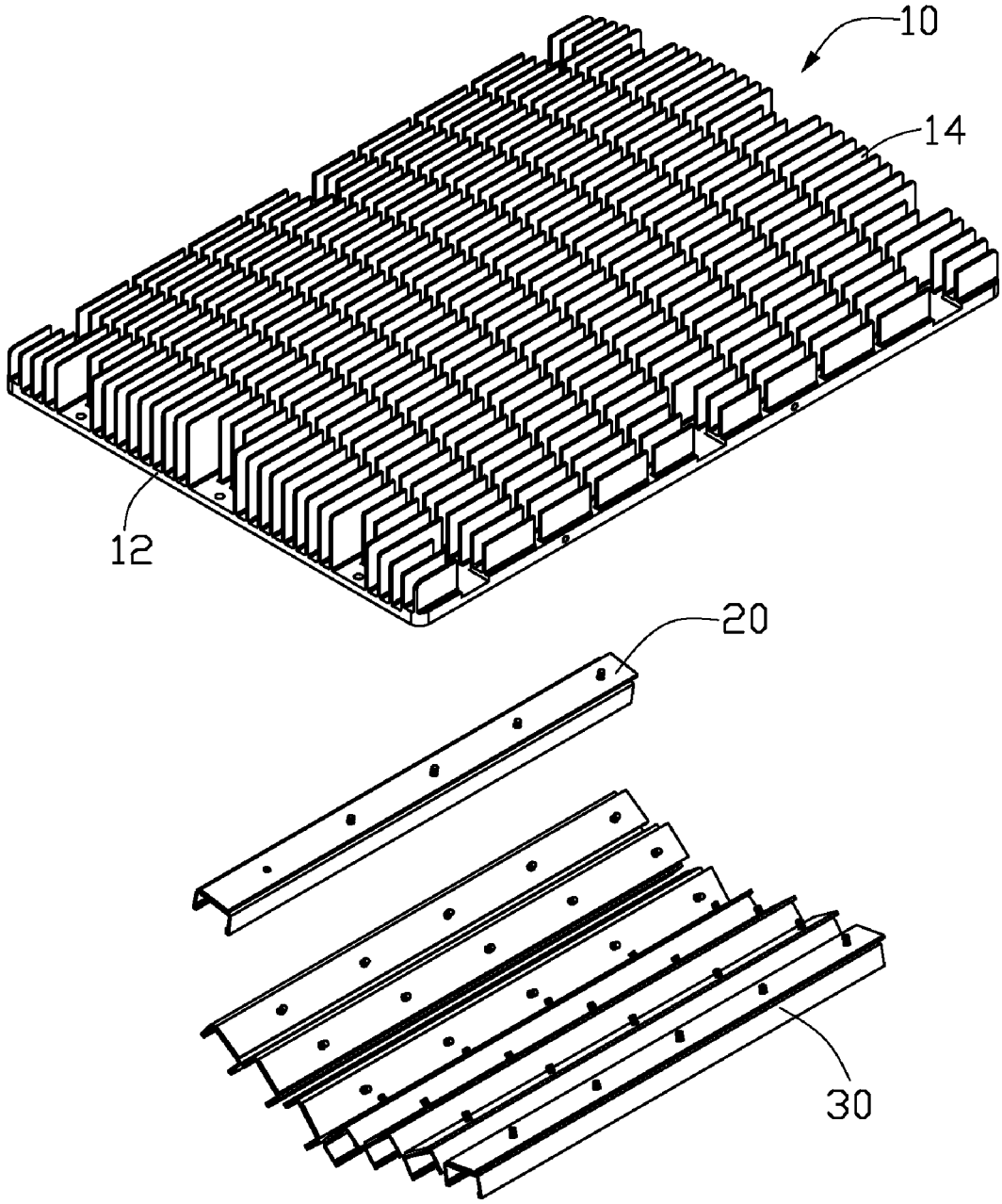
FIG. 3 is an inverted view of the LED lamp of FIG. 2.

Referring to FIGS. 1-3, an LED lamp in accordance with a preferred embodiment is illustrated. The LED lamp assembly comprises a heat sink 10, a plurality of LED modules 20 fixed to a top of the heat sink 10, and a plurality of light-guiding modules 30 respectively mounted on the LED modules 20.

The heat sink 10 is integrally made of a metal with good heat conductivity such as copper or aluminum, and comprises a rectangular base 12, a plurality of fins 14 extending downwardly from a bottom surface of the base 12 and a plurality of mounting members arranged on a top surface of the base 12. The fins 14 spaced from each other are perpendicular to the bottom surface of the base 12 and parallel to two opposite lateral sides and the midline of the base 12.

The mounting members include a first mounting member 15 located at a midline of the top surface of the base 12 and a plurality of second mounting members 16 located at two lateral sides of the first mounting member 15. The first mounting member 15 comprises a first connecting plate 152 extending upwardly from the top surface of the base 12 and two first mounting plates 154 extending laterally and downwardly from two opposite sides of a top end of the first connecting plate 152. The first connecting plate 152 is perpendicular to the top surface of the base 12 and parallel to the fins 14. The two first mounting plates 154 are positioned symmetrically relative to the first connecting plate 152 and angled from the top surface of the base 12. The second mounting members 16 are positioned symmetrically relative to the midline of the base 12 and the first mounting member 15. The second mounting members 16 comprise a plurality of second connecting plates 162 parallel to the first connecting plates 152 and a plurality of second mounting plates 164 respectively and obliquely extending from top ends of the second connecting plates 162. The two outmost second mounting plates 164 of the present embodiment directly extend upwardly from the top surface of the base 12, without second connecting plates 162 therebelow. The second connecting plates 162 are lower than the first connecting member 152 and decrease in height from the midline toward two opposite lateral sides of the base 12. The second mounting plates 164 on which the LED modules 20 are respectively mounted on and angled from the top surface of the base 12. The angles between the first and second mounting plates 154, 164 and the top surface of the base 21 gradually decrease from the midline of the top surface of the base 12 toward the two opposite lateral sides of the base 12. Thus, the LED lamp has a wider illumination angle than other LED lamps. Each of the first and second mounting plates 154, 164 on which one of the LED modules 20 is mounted defines a plurality of fixing orifices 1640 therein along a longitudinal axis for fixing the LED modules 20 thereon.

Figure 4:
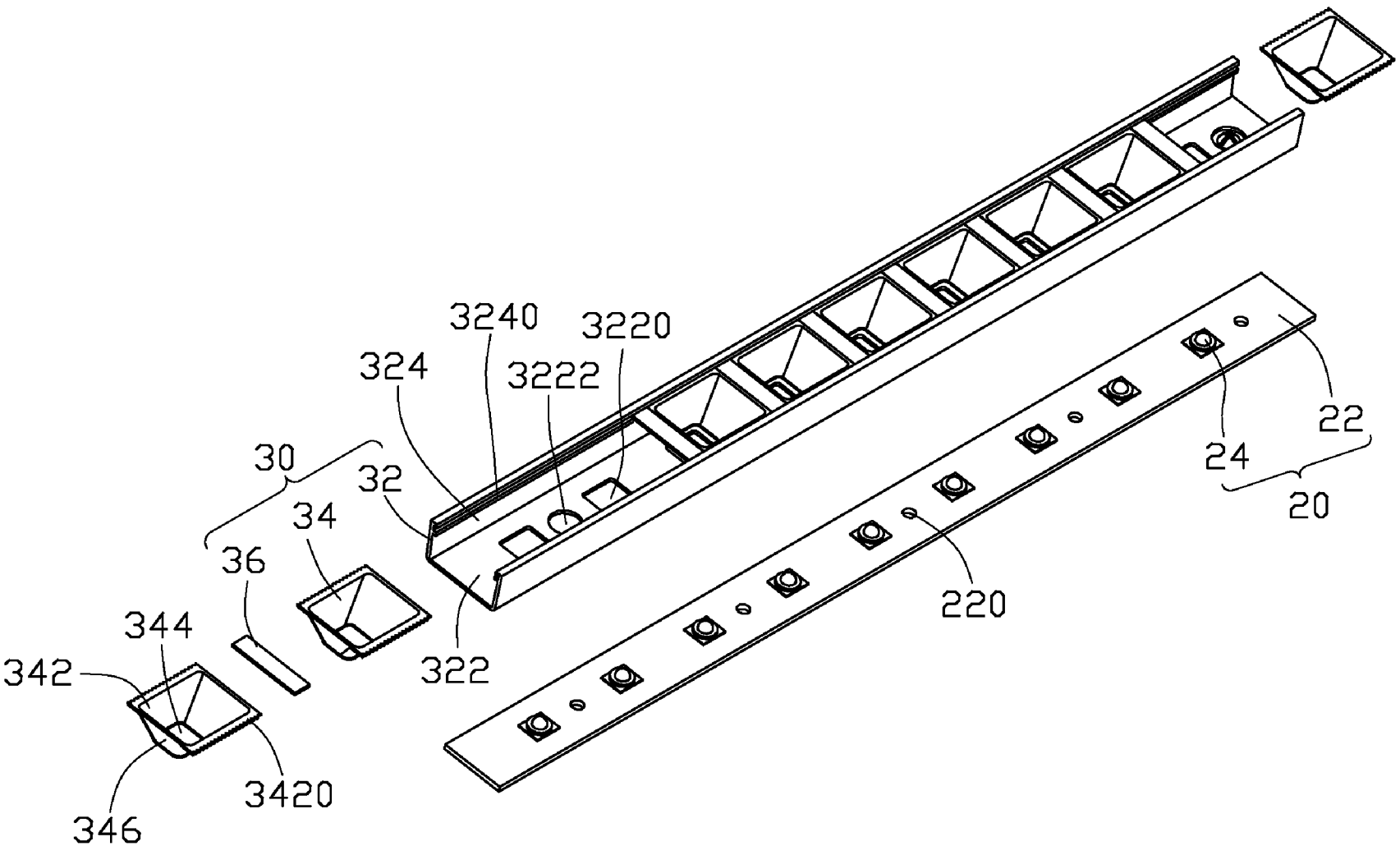
FIG. 4 is an enlarged, exploded view of a light-guiding module together with an LED module of FIG. 2.

Also referring to FIG. 4, each LED module 20 comprises an elongated printed circuit board 22 and a plurality of spaced LEDs 24 evenly mounted on a side of the printed circuit board 22. The LEDs 24 of each LED module 20 are arranged along a longitudinal axis of the printed circuit board 22. Each LED module 20 defines a plurality of extending orifices 220 therein between two of the LEDs 24 and is mounted on a corresponding first or second mounting plate 154/164 of the mounting member 15, 16 of the heat sink 10 by screws (not shown) extending through the extending orifices 220 to engage in the fixing orifices 1640 of the first or second mounting plate 154/164.

Each light-guiding module 30 is fixed on one of the LED modules 20 to guide the light generated by the LEDs 24 in a predetermined manner. Each light-guiding module 30 comprises a mounting frame 32, a plurality of guiding units 34 mounted in the frame 32, and a plurality of rectangular partition boards 36 mounted in the frame 32 and separating the guiding units 34.

Each of the mounting frames 32 comprises an elongated bottom panel 322 and two side panels 324 extending perpendicular to and upwardly from two opposite lateral sides of the bottom panel 322. The bottom panel 322 defines a plurality of rectangular holes 3220 therein and a plurality of circular holes 3222 therein between the rectangular holes 3220. The rectangular through holes 3220 are respectively in alignment with the LEDs 24 of the LED modules 20 and receive the LEDs 24 therein when the bottom panel 322 of corresponding frame 32 is snugly attached on the printed circuit board 22 of the LED module 20. The circular holes 3222 are respectively in alignment with the through orifices 220 of the LED module 20 for coupling the frame 32 onto the corresponding LED module 20. The side panels 324 define two elongated runners 3240 respectively in inner sides thereof and facing each other. The two runners 3240 are parallel to the bottom panel 322 of the frame 32 and extend along top ends of the side panels 324 from one to the opposite ends of the side panels 324.

Each of the guiding units 34 comprises four inclined sidewalls 346 interconnected to define a rectangular upper opening 342 by upper ends thereof and a rectangular lower opening 344 by lower ends thereof. The lower opening 344 is smaller than the upper opening 342. Each of the guiding units 34 has two engaging flanges 3420 extending laterally and horizontally from two lateral sides of the upper ends of the inclined sidewalls 346 received in the runners 3240 of the side panels 324 of the frame 32 to position the guiding units 34 movably along a longitudinal direction in the frame 32.

During assembly, the LED modules 20 are placed on the first and second mounting plates 154, 164 of the heat sink 10 respectively. The bottom panels 322 of the frames 32 of the light-guiding modules 30 are then respectively placed on the printed circuit boards 22 of the LED modules 20 with the LEDs 24 of the LED modules 20 respectively projecting into the rectangular holes 3220 of the bottom panels 322. The engaging flanges 3420 of the guiding units 34 and opposite ends of the partition boards 36 are alternately inserted into the runners 3240 of the side panels 324 of the frame 32 from openings of the runners 3240 in ends of the side panels 324 to mount the guiding units 34 and the partition boards 36 in the frame 32. The engaging flanges 324 of the guiding units 34 and the partition boards 36 are movable along the runners 3240 to adjust the guiding units 34 to proper positions where the lower openings 344 of the guiding units 34 are respectively in alignment with the rectangular holes 3220 of the frames 32 and face directly to the LEDs 24 of the LED modules 20.

According to above-mentioned descriptions, the individual guiding units 34 are assembled through the frames 32 to form the light-guiding modules 30, suitable for the LED modules 20 of the disclosed embodiment and further for various types of frames to suit different types of LED modules in different LED lamps.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light-guiding module for being fixed on an LED module to guide light emitted by a plurality of LEDs of the LED module, comprising:

a frame having a bottom panel for being placed on the LED module and two side panels extending upwardly from two opposite edges of the bottom panel, wherein the two side panels respectively define two runners in inner sides thereof and facing each other; and a plurality of guiding units having two engaging flanges extending outwardly and laterally from two opposite lateral sides thereof;

wherein the two engaging flanges of each of the guiding units are respectively received in the two runners of the frame and movable along the runners to adjust a position of the each of the guiding units in the frame, the each of the guiding units being for receiving a corresponding LED therein for reflecting and guiding light generated by the corresponding LED in a predetermined manner.

2. The light-guiding module as claimed in claim 1, wherein the runners are parallel to the bottom panel of the frame and extend along top ends of the side panels from one ends to opposite ends of the side panels.

3. The light-guiding module as claimed in claim 1, wherein the bottom panel is perpendicular to the side panels and defines a plurality of holes for respectively receiving the LEDs therein.

4. The light-guiding module as claimed in claim 1, wherein each of the guiding units comprises four inclined sidewalls interconnected to each other to define a rectangular upper opening by upper ends thereof and a rectangular lower opening by lower ends thereof.

5. The light-guiding module as claimed in claim 4, wherein the lower opening is smaller than the upper opening and in communication with a corresponding hole of the bottom panel, and the engaging flanges extend laterally and horizontally from two opposite sides of upper ends of the sidewalls.

6. The light-guiding module as claimed in claim 1, further comprising a plurality of partition boards each having two opposite ends respectively received in the two runners and separating the guiding units from each other.

7. An LED lamp, comprising a heat sink comprising a base and a plurality of fins extending downwardly from a bottom surface of the base;

a plurality of LED modules mounted on a top of the heat sink; and a plurality of light-guiding modules respectively fixed on the LED modules, each comprising a frame having a bottom panel on a corresponding LED module and two side panels extending upwardly from two opposite edges of the bottom panel and a plurality of guiding units each having two engaging flanges extending outwardly and laterally from two opposite lateral sides thereof;

wherein the two side panels respectively define two runners in inner sides thereof and facing each other and the two engaging flanges of each of the guiding units are respectively received in the two runners of the frame and movable along the runners to adjust a position of the each of the guiding units in the frame; and wherein each of the LED modules has a plurality of LEDs, the each of the guiding units receiving a corresponding LED therein for guiding and reflecting light generated by the corresponding LED in a predetermined manner.

8. The LED lamp as claimed in claim 7, wherein the heat sink comprises a plurality of mounting members each having a connecting plate extending upwardly from a top surface of the base and a mounting plate connected to a top end of the connecting plate, one of the LED modules being mounted on the mounting plate.

9. The LED lamp as claimed in claim 8, wherein the connecting plates are parallel to each other, perpendicular to the base and decrease in height from a midline of the top surface of the base toward two lateral opposite sides of the base.

10. The LED lamp as claimed in claim 8, wherein the mounting plates are mounted on and angle from the top surface of the base, wherein the angles between the mounting plates and the top surface of the base gradually decrease from a midline of the top surface of the base toward the two opposite lateral sides of the base.

11. The LED lamp as claimed in claim 8, wherein the fins are perpendicular to the base and parallel to two opposite lateral sides of the base and the connecting plates.

12. The LED lamp as claimed in claim 7, wherein the runners are parallel to the bottom panel of the frame and extend along top ends of the side panels from one to opposite ends of the side panels.

13. The LED lamp as claimed in claim 7, wherein the bottom panel is perpendicular to the side panels and defines a plurality of holes respectively receiving the LEDs therein.

14. The LED lamp as claimed in claim 13, wherein each of the guiding units comprises four inclined sidewalls interconnected to each other to define a rectangular upper opening by upper ends thereof and a rectangular lower opening by lower ends thereof.

15. The LED lamp as claimed in claim 14, wherein the lower opening is smaller than the upper opening and in communicating with a corresponding hole of the bottom panel, the engaging flanges extend laterally and horizontally from two opposite sides of upper ends of the sidewalls.

16. The LED lamp as claimed in claim 7, wherein each light-guiding module comprises a plurality of partition boards each having two opposite ends respectively received in the two runners and separating the guiding units from each other.

* * * * *